US005078201A

United States Patent [19]

Nakamura

[11] Patent Number: 5,078,201

[45] Date of Patent: Jan. 7, 1992

[54] CASTING CORE FABRICATING APPARATUS

[75] Inventor: Nobuhiro Nakamura, Osaka, Japan

[73] Assignee: Osaka Shell Industry Co., Ltd., Osaka, Japan

[21] Appl. No.: 441,383

[22] Filed: Nov. 27, 1989

[51] Int. Cl.[5] ..... B22C 5/12

[52] U.S. Cl. ..... 164/154; 164/155; 164/186; 164/193; 164/201

[58] Field of Search ..... 164/193, 194, 186, 154, 164/155, 456, 200, 201, 192, 228

[56] References Cited

U.S. PATENT DOCUMENTS

| | | | |
|---|---|---|---|
| 2,779,071 | 1/1957 | Herbruggen | 164/155 |
| 2,978,759 | 4/1961 | Hansberg | 164/155 |
| 3,482,619 | 12/1969 | Hulslander | 164/186 X |
| 3,528,481 | 9/1970 | Lund | 164/186 X |

FOREIGN PATENT DOCUMENTS

| | | | |
|---|---|---|---|
| 694798 | 9/1964 | Canada | 164/201 |
| 45-12843 | 5/1970 | Japan | 164/155 |
| 50-21294 | 7/1975 | Japan | 164/154 |
| 59-42157 | 3/1984 | Japan | 164/456 |
| 59-169645 | 9/1984 | Japan | 164/456 |
| 1235624 | 6/1986 | U.S.S.R. | 164/154 |

*Primary Examiner*—J. Reed Batten, Jr.
*Attorney, Agent, or Firm*—Schweitzer Cornman & Gross

[57] ABSTRACT

The apparatus includes a casting core forming die, a mold sand feeder with an opening, a mold sand tank, a suspension device for lifting and for lowering the mold sand tank, supporter and mover for the mold sand tank between a first position where it can be charged with mold sand, and a second position where the mold sand is to be transferred to the casting core forming die, a device for weighing the mold sand tank when it is lowered onto the supporter and mover, and an opener and closer for the opening of the mold sand feeder upon the weighing device emitting a signal.

6 Claims, 6 Drawing Sheets

CASTING CORE FABRICATING APPARATUS

FIELD OF THE INVENTION

The present invention relates to fabricating apparatus for cores used in casting and molding. The core is necessary when forming a hollow casting, and a casting core of a desired shape is fabricated by charging mold sand impregnated with thermosetting resin into a mold, and then heat treating it.

BACKGROUND OF THE INVENTION

Casting core fabricating apparatus comprises a mold sand feeder, a mold sand tank to be filled with a specified quantity of mold sand supplied by the feeder, a vehicle for lifting the tank when it was filled with a specified quantity of mold sand and moving it to a position confronting the mold for the core, and a mold sand charger for charging by force into the mold the mold sand from the tank in the position confronting the mold.

The mold sand charged into the mold is heated and the resin therein is cured, resulting in a completed casting core of a desired shape.

The mold sand tank, after charging the sand into the mold, is returned by the vehicle to the position confronting the mold sand feeder and the tank is filled again with a necessary quantity of mold sand for forming a core, and the same operation is repeated.

In this way, in every mold forming cycle, the mold sand tank is filled with mold sand, the entire mold sand in the tank is charged into the mold by the mold sand charger by forcing the sand by an air or other jet means, and then the core is heated and cured. Therefore the mold sand tank must be filled with a specific quantity of mold sand suited exactly to the volume charged into the mold in each cycle.

Conventionally, the supply of mold sand from the mold sand feeder into the mold sand tank is controlled by a timer. The time required to fill up the tank is usually predetermined by experience or calculation, to stop the supply of mold sand when reaching the present time.

In this conventional mold sand filling method, if the flow of the mold sand is slow due to the type of mold sand, humidity, ambient condition or the like, the actual quantity of sand charged into the tank can be smaller than specified, or if the flow of the mold sand is faster than necessary, then too much mold sand is charged into the tank. It was thus difficult to maintain the feed of mold sand at a reasonably constant level. Thus, the degree of consolidation of the fabricated core is not constant and this results in defective products.

SUMMARY OF THE INVENTION

Therefore, it is a primary object of the invention to solve the aforementioned drawbacks of the above-discussed problems in the conventional fabricating apparatus with timer-controlled operation of the supply of mold sand from the mold sand feeder into the mold sand tank, by providing a casting core fabricating apparatus capable of determining by weight control the amount of sand to be filled into the tank and the mold, without relying on the time control. This is accomplished in accordance with the present invention, by measuring the weight of the mold sand charged into the mold sand tank, stopping the supplying of the mold sand into the tank when it has reached the preset weight.

If the mold sand is poorly or smoothly flowing, even then, the tank is always accurately filled with the same specified weight of mold sand, regardless of the feeding speed or the feeding time, and stops the feeding when the amount of sand introduced into the tank reaches the predetermined weight.

DETAILED DESCRIPTION OF A PREFERRED EMBODIMENT

Figure 1:
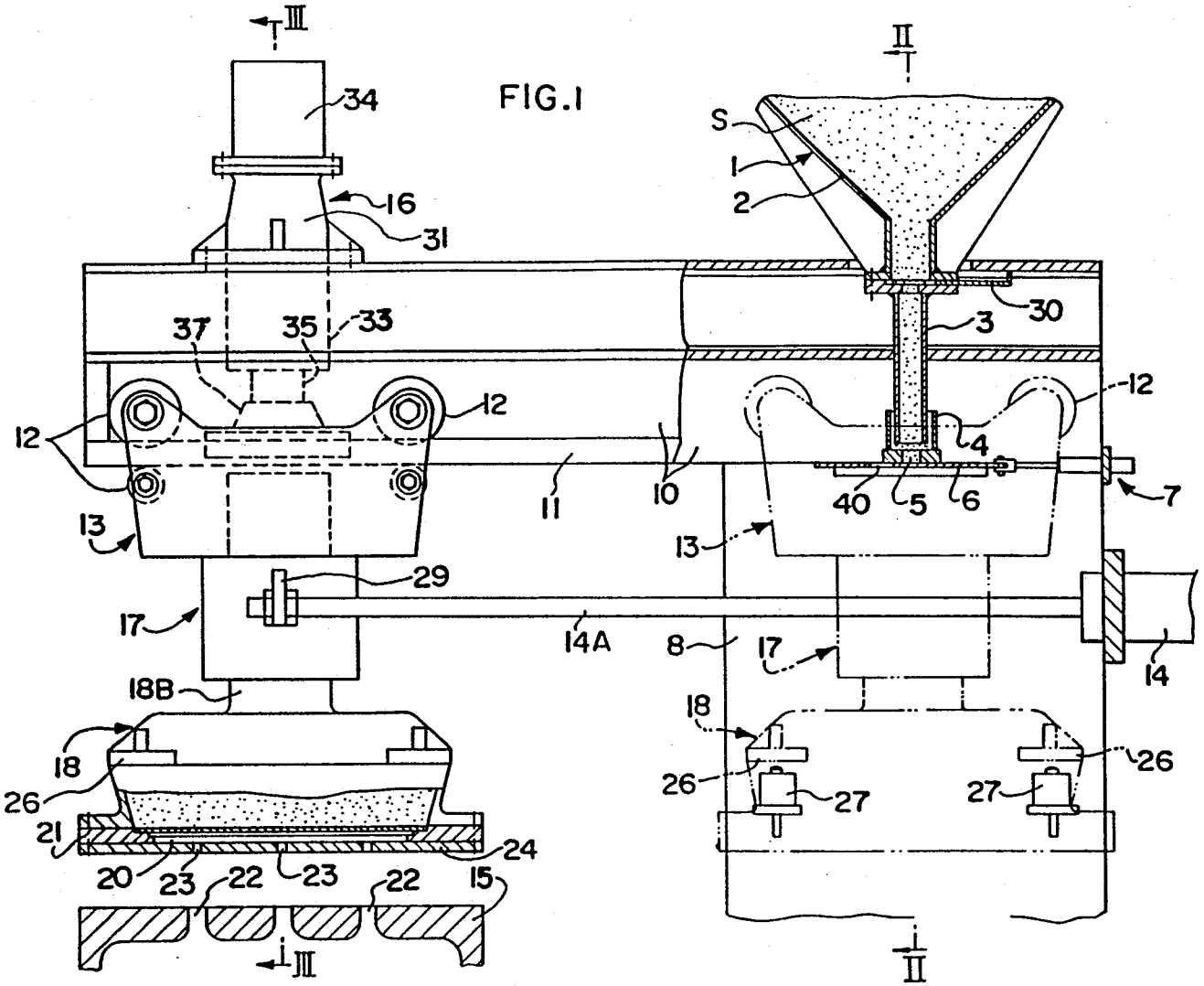
FIG. 1 is a front view in partial cross-section of an embodiment of the invention.

As shown in FIG. 1, a mold sand feeder 1 comprises a hopper 2 which is filled with mold sand S supplied from an external container, (not shown), a feed tube 3 extending downward from the end of the hopper 2, and a mold sand leak preventing tube 4 disposed at the lower end of the feed tube 3. A feed nozzle 5 is attached to the front end of the leak preventing tube 4, and a valve 6 for opening and closing the nozzle 5 is disposed so to be movable laterally in the drawing, by a drive unit 7 containing a fluid pressure cylinder.

The mold sand feeder 1 is mounted on a pair of posts 8, 8 (FIG. 2), and a horizontal beam 9 stretching in the horizontal direction and being supported by both posts 8, 8. This horizontal beam 9 supports a pair of suspended guide rails 11, 11 in the longitudinal direction, by a pair of mounting plates 10, 10. A vehicle 13 is adopted to move horizontally along the guide rails 11, 11 by guide rollers 12, 12 which are adopted to roll on both guide rails 11.

The vehicle 13 is moved reciprocatingly by a drive untit 14. This unit includes a fluid pressure cylinder, and a piston (not shown) within said cylinder adopted to drive reciprocating rod 14A. The reciprocating movement of vehicle 13 takes place from one extreme position confronting the mold sand feeder 1 as indicated by a dot-dash line in FIG. 1, its other extreme position confronting the mold for core 15 (shown in the lower left part of FIG. 1), and a mold sand charger 16.

A mold sand tank 18 is suspended from the vehicle 13 by a suspension device 17.

Figure 2:
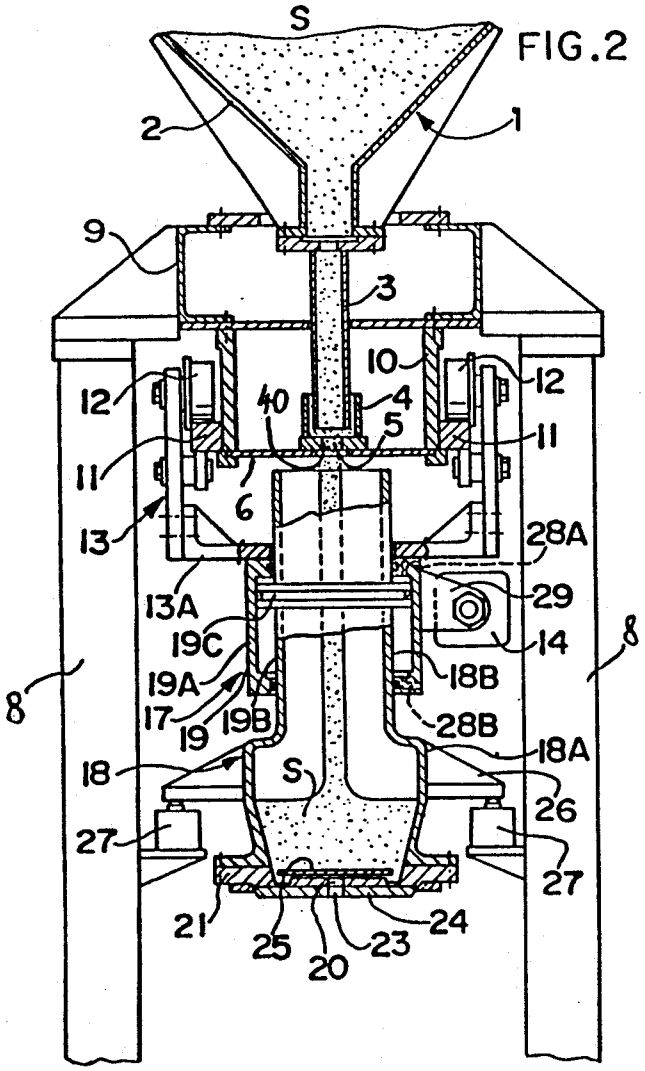
FIG. 2 is a cross-sectional view taken along the line II—II in FIG. 1.

As shown in FIG. 2, the suspension device 17 comprises a fluid pressure cylinder 19 such as an air cylinder, and its cylinder tube 19A is attached to the lower surface 13A of the vehicle 13. The mold sand tank 18 has a tank main body 18A and an upper cylindrical part 18B. The upper cylindrical part 18B ranges upward into the fluid pressure cylinder 19. Feed port 18C of the tank 18 is adopted to confront the feed nozzle 5.

Therefore, the upper cylindrical part 18B of the tank also plays the role of hollow piston rod of the fluid pressure cylinder 19, and a piston 19C is arranged about the outer circumference of the rod 18B to provide a fluid tight seal against the interior of the cylinder 19A.

In the lower part of the main body 18A of the tank a bottom lid 21 plugs the lower surface of the main body 18A and has an opening 20 in its center part. A blow plate 24 is disposed at the lower surface of the bottom lid 21 and has a blow-out hole 23 communicating with the opening 20 penetrated at the position corresponding to the mold sand charge port 22 (FIG. 1) of the core mold 15, and a baffle plate 25 disposed in the tank main body 18A close to the bottom lid 21. The baffle plate 25 is designed to prevent the mold sand S from flowing out spontaneously through the opening 20 and the blow-out port 23 by keeping the weight of the mold sand S from pressing against the opening 20.

Support arms 26, 26 project at four peripheral positions on the outer circumference of the tank main body 18A, and weighing scales 27, 27 are suitably strain gauge type weight sensors (load cell) that are mounted on the posts 8, 8, opposite to the support arms 26, 26. The tank main body 18 is mounted on the weighing scales 27, 27 by support arms 26, 26 as to be described as mentioned below in more detail.

Supply and discharge ports 28A, 28B are provided for the fluid pressure cylinder 19, and a bracket 29 is linked to the front end of the piston rod 14A of the vehicle driving cylinder 14. A manual opening valve 30 is disposed on the top of the mold sand feed tube 3.

Figure 3:
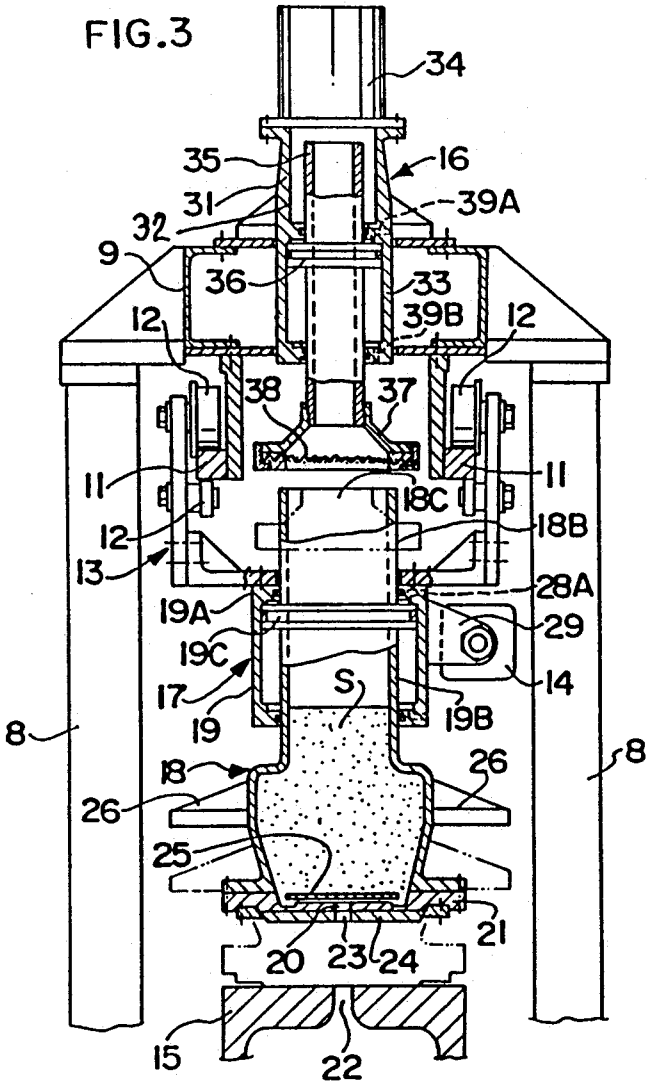
FIG. 3 is a cross-sectional view taken along the line III—III in FIG. 1.

The mold sand charger 16 shown at the left side of FIG. 1 comprises, as shown in more detail in FIG. 3, an air jet cylinder 31 affixed to the horizontal beam 9, a blow plate pressing cylinder 33 with an integrally formed partition wall 32 at its lower part, and a changeover valve 34 disposed at the upper end of the air jet cylinder 31, and an air feed tube 35 is disposed so that it penetrates both cylinders 31, 33, and a piston 36 is affixed to the feed tube 35 within the blow plate pressing cylinder 33, and the upper end of the feed tube 35 is open within the air jet cylinder 31. A funnel-shaped blow flange 37 and a sand filter 38 are installed at the lower end part of the feed tube 35. Supply and discharge ports 39A and 39B are disposed within the blow plate pressing cylinder 33.

The operation of this structure is explained below sequentially. With the mold sand filling hopper 2 positioned opposite to the mold sand feeder 1 at the right side of FIG. 1, the compressed air in the fluid pressure cylinder 19 which is suspended by the suspension device 17, is released into the atmosphere to change over to the no-load state, and thereby the mold sand tank 18 drops by gravity, and is put on the sensors 27 by support arms 26. In other words, the suspension state between the vehicle 13 and the mold sand tank 18 is released, and the tank 18 is set free, so that only the load of the tank 18 is applied to the sensors 27.

Application of the weight of the mold sand tank 18 onto the sensors 27 is detected by this output signal from the sensors 27, and the opening valve drive unit 7 is actuated by the detection signal, to operate the opening valve 6 into that releasing position. As a result, as shown in FIG. 2, the valve hole 40 of the opening valve 6 and the feed nozzle 5 communicate with each other, and the mold sand S in the hopper 2 is fed into the tank main body 18A to fill it up. This feed weight is measured by the sensors 27, and when the measured weight and the set value coincide, the opening valve drive unit 7 is again actuated by this detection signal to close the opening valve 6, so that the feed nozzle 5 will also close. In this case, the feed weight of the mold sand S supplied into the mold sand tank 18 is not adjusted by the timer as in the prior art, but is rather adjusted by weight control. Thus a specified weight can be accurately measured regardless of the flow performance of the mold sand S. For example, when the weight is set to 10 kg, upon, the weight measured by the weighing scale reaching 10 kg, the opening valve 6 is closed, so that the specified weight can be measured always accurately. If there is a possibility of excessive feed due to time lag from the moment of transmission of detection signal of the sensors 27 till a complete shutoff of the supply of mold sand, then when the extra feed of mold sand is e.g. 500 g while the specified weight is 10 kg, the present value can be determined at 9.5 kg, so that the specified quantity of mold sand as 9.5 kg+500 g=10 kg will be supplied into the tank 18.

After charging of the mold sand into the tank 18 into the core mold 15, when the mold sand is supplied into the tank 18 after moving to the mold sand feed position, if the mold sand in the tank is not discharged completely in the previous process and part of it is left over in the tank 18, and it is weighed by the sensors 27 and then fresh mold sand is charged into the tank 18, since the weight in the tank 18 is predetermined, errors are not likely to occur.

When a specified quantity of mold sand is charged into the mold sand tank 18, the suspension device 17, that is, the fluid pressure cylinder 19 is actuated to raise the piston and the mold sand tank 18 attached thereto, to clear it from the sensors 27.

The mold sand tank 18 suspended on the vehicle 13 by the suspension device 17 is transferred to the left side of FIG. 1 by the vehicle drive unit 14. At this position the fluid pressure cylinder 19 on the suspension device 17 is actuated to lower the mold sand tank 18 from the mounting position to the position indicated by dot-dash lines in FIG. 3, and the blow-out port 23 of the blow plate 24 is joined to the mold sand charge port 22 of the core forming mold 15, while the air feed tube 35 of the molding sand charger 16 is pressed against the opening end face of the cylindrical tank part 18B together with the blow flange 37 by actuating the blow plate pressing cylinder 33.

An air jet is injected into the mold sand tank 18 through the air feed tube 35 from the air source by changing over the changeover valve 34. By this air pressure, the mold sand S in the mold sand tank 18 is injected into the gap between the baffle plate 25 and the bottom lid 21, and into the die 15 from the blow-out port 23 through the opening 20. In the die 15, a specified weight of mold sand is accurately charged into the mold and is heated, so that a casting core of uniform degree of consolidation and high quality can always be manufactured.

After injection, the changeover valve 34 is changed to release the mold sand tank 18 to the atmosphere to release air pressure from the tank 18. At this time, since the upper end of the tank 18 is plugged with sand filter 38, the mold sand in the tank 18 will not scatter outward through the air feed tube 35.

Then the air feed tube 35 is lifted by actuating, and the suspension device 17 is actuated to pull up the mold sand tank 18. The tank 18 is then returned by means of the vehicle drive unit 13, to the position where it confronts the mold sand feeder 1 and the same operation is repeated thereafter.

Figure 4:
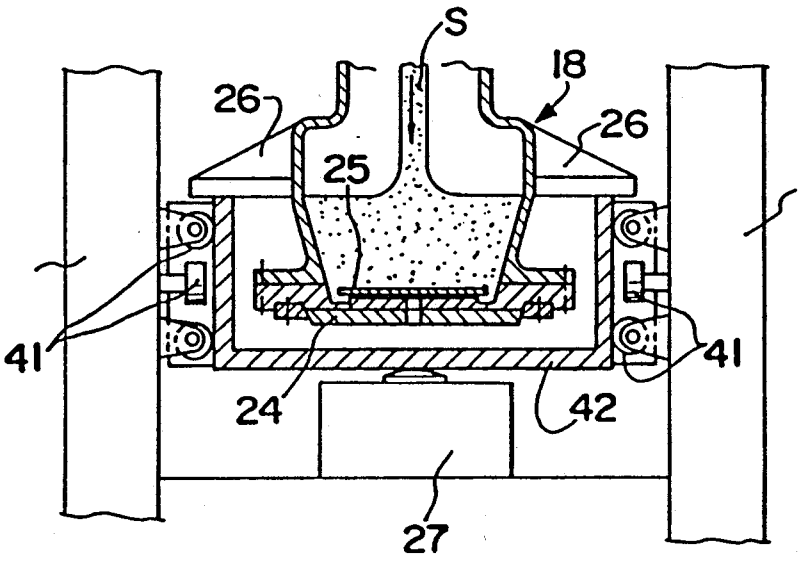
FIG. 4 is a longitudinal cross-sectional view showing a modified example of essential parts of FIG. 2.

Four sensors 27 are used as weighing scales in the foregoing embodiments, but as shown in FIG. 4 instead, a pi-shaped guide frame 42 elevated by guide rollers 41, can be mounted on one sensor 27, and the mold sand tank 18 can be placed for weighing onto the guide frame 42.

FIGS. 5–10 relate to a second embodiment of the invention, wherein the mold sand feeder 1, hopper 2, mold sand charger 16, mold sand tank 18, driving part of vehicle 13, and mold 15 are same in structure as those in the first embodiment, and are identified with the same reference numbers and are not specifically explained in detail herein.

A pertinent characteristic of the second embodiment of FIGS. 5–10 lies in a suspension device 117 and an engaging device 43 that is part of the suspension device 117.

Figure 5:
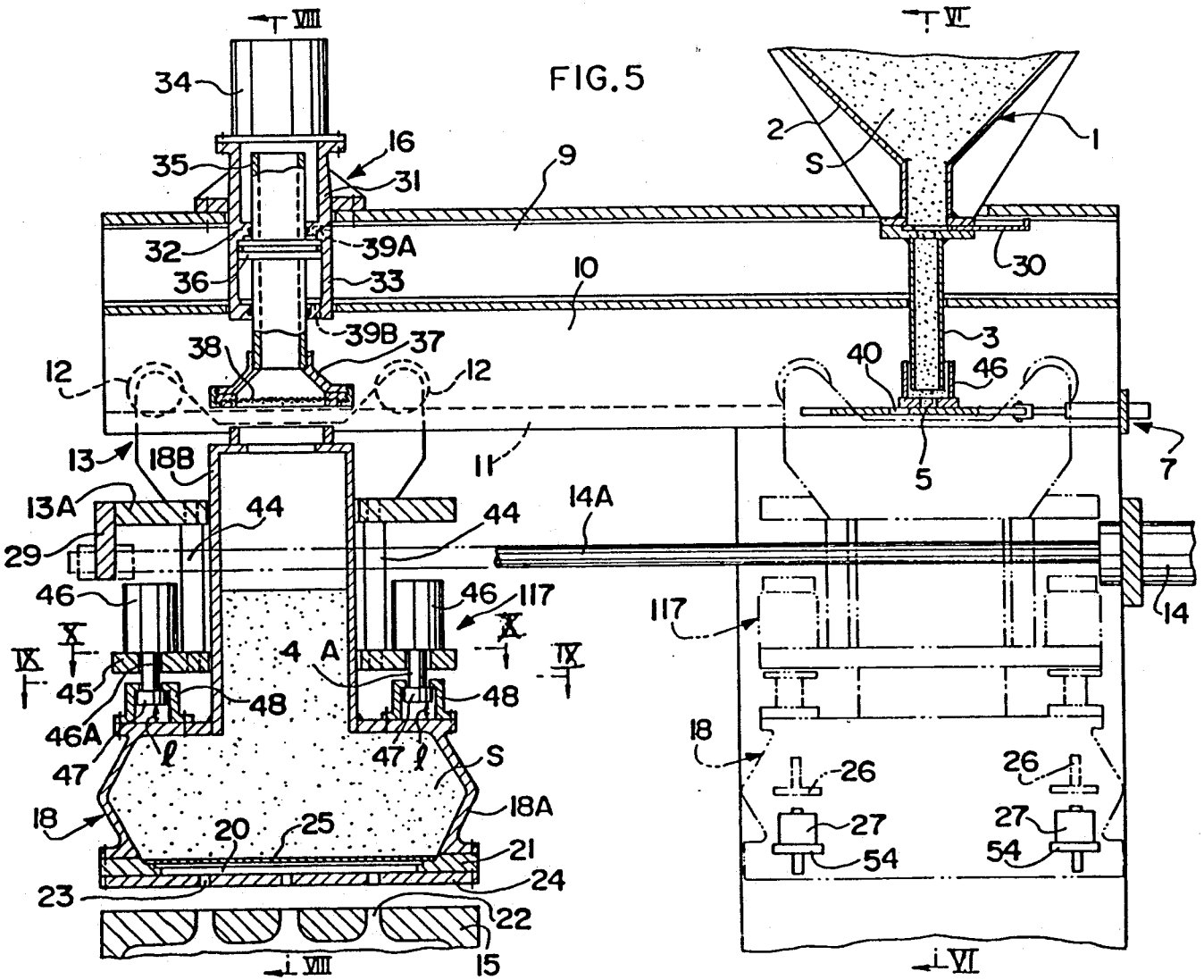
FIG. 5 is a front view partially in cross section of another embodiment of the invention.

As shown at the left side of FIG. 5, beneath the bottom plate 13A of the vehicle 13, a horizontal support plate 45 is integrally installed by means of four connecting rods 44 (see FIG. 9), and an upper cylindrical part 18B of the mold sand tank 18 is disposed by penetrating through these two plates 13A, 45. The horizontal support plate 45 is provided with a pair of fluid pressure cylinders 46 forming a part of the suspension device 117. This device is disposed across the upper cylindrical part 18B so that the piston rods 46A, 46A can be directed downward (FIG. 9, FIG. 10), and engaging pieces 47, 47 are attached to the end of the rods. A pair of engaging frames 48, 48 surround the engaging pieces 47, 47 are projecting (FIG. 10) on the upper surface of the mold sand tank 18. These engaging frames 48, 48 must have a stroke $\delta$ allowing the engaging pieces 47, 47 to move relatively freely in the vertical direction.

Figure 6:
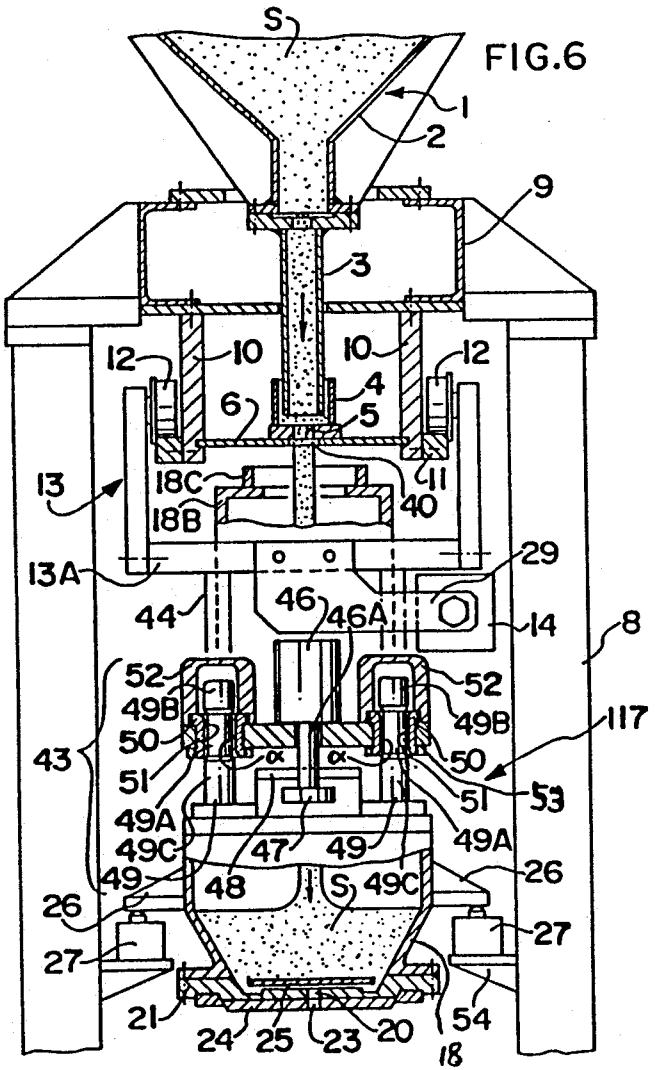
FIG. 6 is a cross-sectional view taken along the line VI—VI in FIG. 5.
Figure 9:
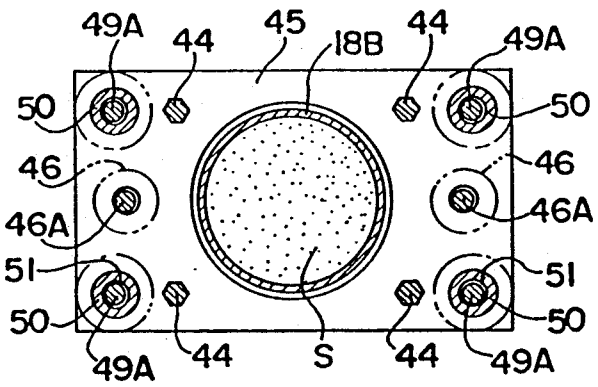
FIG. 9 is a cross-sectional view taken along the line IX—IX at the left side of FIG. 5.
Figure 10:
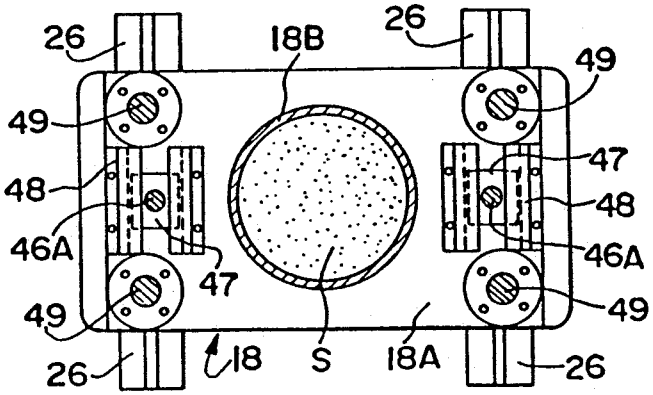
FIG. 10 is a cross-sectional view taken along the line X—X at the left side of FIG. 5.

Four lifting guide rods 49 project (FIG. 6 to FIG. 10) at four corners of the upper surface of the tank main body 18A of the mold sand tank 18, and a guide collar 50 for inserting the guide rods 49 is provided on the horizontal support plate 45. On each guide rod 49 there is a small end part 49A smaller in diameter than the inside diameter of the guide hole 51 opened in the guide collar 50 and longer in length than the length of the guide hole 51. While the small end part 49A opposes the guide hole 51 as shown in FIG. 6, a slight gap $\alpha$ is formed against the hole wall of the guide hole 51. The upper and lower portions of the small end part 49A are formed as large end parts 49B, 49C, having nearly the same diameter as the inside diameter of the guide hole 51. As shown best in FIG. 6, a dust cap 52 is provided for covering the guide hole 51.

When the mold sand tank 18 is in a position confronting the mold sand feeder 1, the mold sand is charged from the hopper 2 into the tank 18. This is accomplished by extending the piston rod 46A of the fluid pressure cylinder 46, and the support arm 26 projecting on the outer circumference of the mold sand tank 18 is placed on the strain gauge type weighing sensor (load cell) 27 mounted on the posts 8, 8 by bracket 54 to support the mold sand tank 18. In this state, by extending the piston rod 46A to the maximum stroke, as shown in FIG. 6, the engaging piece 47 at the front end of the piston rod 46A is disengaged from the engaging frame 48 within a range of the stroke height $\delta$ of the engaging frame 38. The small end part 49A of the lifting guide rod 49 confronts the guide hole 51 provided in the horizontal support plate 45, and a gap $\alpha$ is produced between the two plates. As a result, the mold sand tank 18 is completely released from the suspension state by the vehicle 13, so that the weight of the mold tank 18 is applied onto the weighing sensor 27. The lifting guide rod 49, the engaging piece 47, engaging frame 48, and small end part 49A inserted in the guide hole 51 to maintain or release the suspension state of the mold sand tank 18 and the vehicle 13, overall constitute the engaging device 43 which is a part of the suspension device 117 of the present invention.

The suspension state of the mold sand tank 18 is released by the action of this engaging device 43, and the weight of the tank 18 is detected by the weighting sensor 27. This detection signal actuates the opening valve drive unit 7 so that the feed nozzle 5 of the hopper 2 closed by the opening valve 6 is released, and the tank 18 is filled with mold sand. The mold sand filling weight is determined by the sensors 27, and when the measured weight agrees with the preset value, the drive unit 7 is actuated again by the detection signal. The feed nozzle 5 is closed by the opening valve 6, and the tank 18 is always accurately filled with a specified weight of mold sand.

Figure 7:
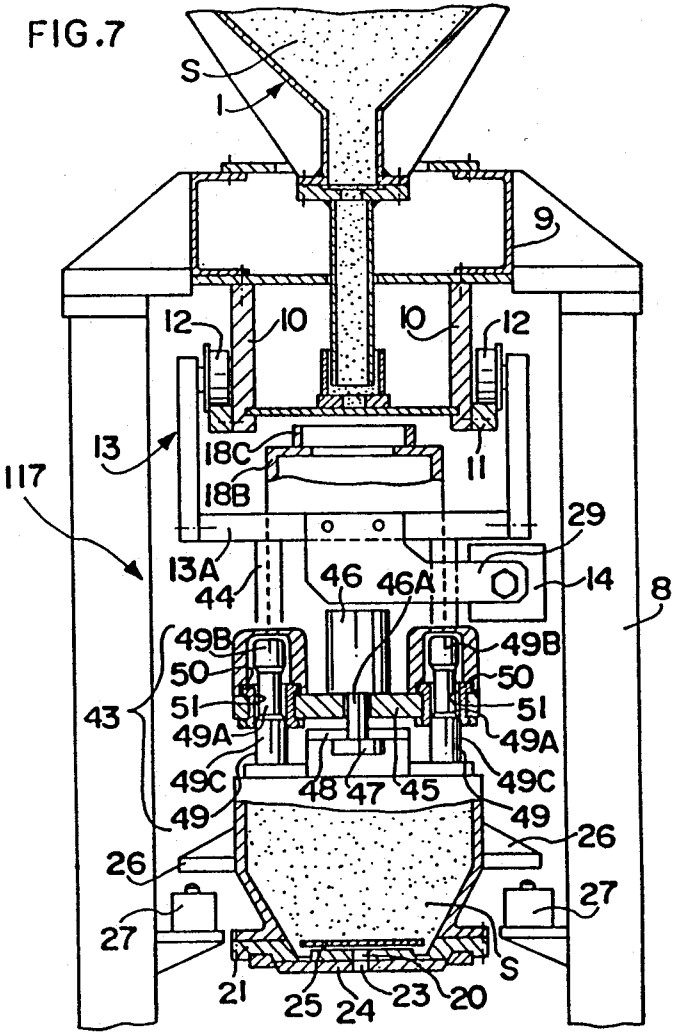
FIG. 7 is a cross-sectional view similar to FIG. 6, showing a different operating stage of the apparatus.

As shown in FIG. 7, the piston rod 46A of the fluid pressure cylinder 46 for suspension is contracted, and the engaging piece 47 at its front end is engaged with the engaging frame 48 of the tank 18. This lifts up the tank 18, and therefore the large end part 49C beneath the lifting rod 49 is engaged with the guide hole 51 without any gap. As a result, the mold sand tank 18 is supported on the horizontal support plate 45 by the lifting guide rod 49 that passes through the guide hole 51. The tank 18 is suspended on the vehicle 13, thereby preventing oscillation when moving up to the position confronting the mold sand charger 16.

Figure 8:
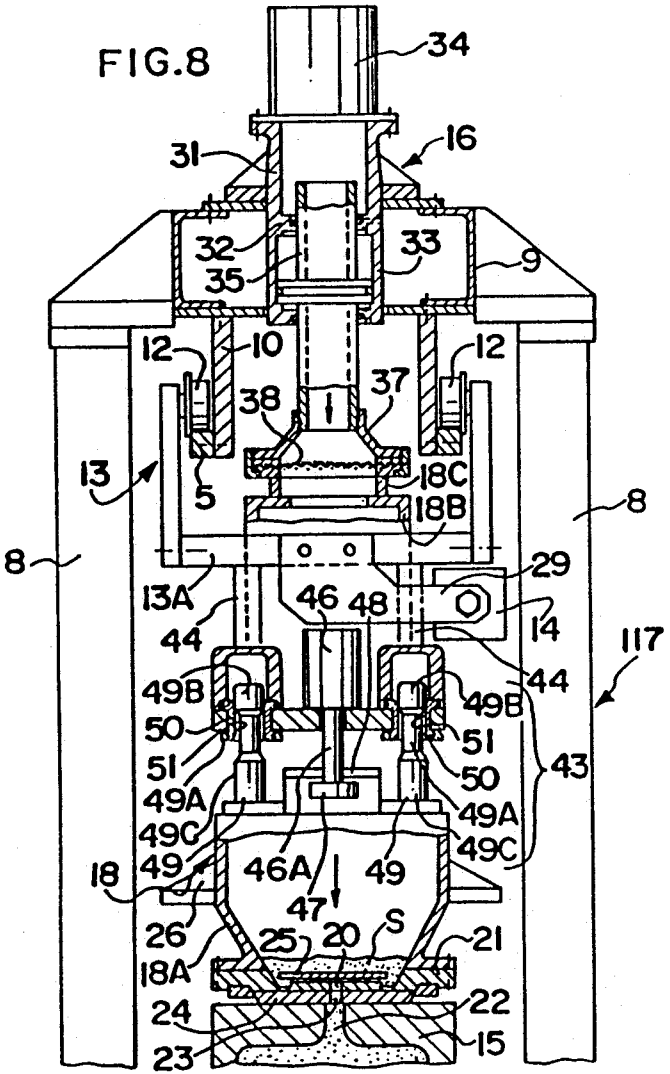
FIG. 8 is a cross-sectional view taken along the line VIII—VIII in FIG. 5.

When the mold sand tank 18 moves horizontally to the mold sand charge position, as shown in FIG. 8, the piston rod 46A of the fluid pressure cylinder 46 for suspension is extended to lower the tank 18 to contact tightly with the core forming mold 15. As this time, the engaging piece 47 at the front end of the piston rod 46A is released from its engagment with the engaging frame 48 in the same manner as described above. The upper large end part 49B of the lifting guide rod 49 fits within the guide hole 51 without clearance, so that the tank 18 is lowered as being guided by the large end part 49B, to prevent any deviation in position of the tank 18 to the mold 15.

Afterwards, the air feed tube 35 of the mold sand charger 16 is moved downward by the blow plate pressing cylinder 33. The blow flange 37 is pressed to the opening end face 18C of the upper cylindrical part 18B of the mold sand tank 18, so that the blow flange 37 is tightly pressed against the upper cylindrical part 18B, and by this pressing force the mold sand tank 18 is pushed downward, and the blow plate 24 at the bottom is pressed forcibly against the mold 15, so that the mold sand charging action can be suitably maintained. When the tank 18 is pushed downward, since the engagement of the engaging piece 47 and engaging frame 48 is released, they cannot become damaged.

The subsequent action is same as in the case of the first embodiment, and is not required to be dealt with here again in any detail.

What is claimed is:

1. A casting core fabricating apparatus, comprising a casting core forming die, a mold sand feeder having an opening, a mold sand tank, a suspension device for lifting said mold sand tank to said mold sand feeder for filling with sand and for lowering the sand-filled mold sand tank, means for supporting and moving said mold sand tank after said suspension device lowered said tank onto said means for supporting and moving, wherein said means for supporting and moving said mold sand tank moves said tank between a first position where it is adapted to be charged with mold sand and a second position where the mold sand is adapted to be transferred into said casting core forming die, a weighing device for weighing said mold sand tank when it has been lowered onto said means for supporting and moving, and means for opening and closing the opening of said mold sand feeder upon the emission of a predetermined signal from said weighing device.

2. The casting core fabricating apparatus of claim 1, wherein said suspension device comprises a fluid pressure cylinder disposed between said means for supporting and moving and said mold sand tank, said fluid pressure cylinder having a cylindrical tube attached to said means for supporting and moving, said mold sand tank having an upper cylindrical part adapted to move as a piston rod within the cylinder of said cylindrical tube for penetrating said cylinder in the vertical axial direction of the tank, and a piston attached about said upper cylindrical part and functioning as a piston rod.

3. The casting core fabricating apparatus of claim 1, wherein said suspension device comprises a plurality of fluid pressure cylinders disposed between said means for supporting and moving and said mold sand tank, said apparatus further comprising means for engaging the lifted or lowered mold sand tank in cooperation with said fluid pressure cylinders.

4. The casting core fabricating apparatus of claim 3, wherein each of said fluid pressure cylinders has a piston rod, said means for engaging further comprising an engaging piece disposed at the end of said piston rod, and an engaging frame for entering into engagement with said engagement piece to enable the engaging piece to move freely and vertically.

5. The casting core fabricating apparatus of claim 3, wherein said means for engaging comprises a guide hole formed on the side of said means for supporting and moving, and a guide rod inserted in said guide hole for vertically guiding the mold sand tank, and a part having a small diameter and being formed at an intermediate position of said guide rod for producing a clearance between said guide hole and said guide rod.

6. The casting core fabricating apparatus of claim 1, wherein said weighing device is a strain gauge.

* * * * *